US012259168B2

(12) United States Patent
Xie et al.

(10) Patent No.: US 12,259,168 B2
(45) Date of Patent: Mar. 25, 2025

(54) ICE-MAKING DEVICE AND REFRIGERATION MACHINE

(71) Applicants: HEFEI MIDEA REFRIGERATOR CO., LTD., Hefei (CN); HEFEI HUALING CO., LTD., Hefei (CN); MIDEA GROUP CO., LTD., Foshan (CN)

(72) Inventors: Yunyun Xie, Hefei (CN); Tuo Liu, Hefei (CN); Zhanhui Chen, Hefei (CN)

(73) Assignees: HEFEI MIDEA REFRIGERATOR CO., LTD., Hefei (CN); HEFEI HUALING CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 18/008,439

(22) PCT Filed: Dec. 31, 2021

(86) PCT No.: PCT/CN2021/143767
§ 371 (c)(1),
(2) Date: Dec. 5, 2022

(87) PCT Pub. No.: WO2023/087513
PCT Pub. Date: May 25, 2023

(65) Prior Publication Data

US 2024/0310102 A1 Sep. 19, 2024

(30) Foreign Application Priority Data

Nov. 19, 2021 (CN) ..... 202111408552.2
Nov. 19, 2021 (CN) ..... 202111408553.7

(51) Int. Cl.
*F25C 1/10* (2006.01)
*F25C 5/04* (2006.01)
*F25C 5/20* (2018.01)

(52) U.S. Cl.
CPC ..... *F25C 1/10* (2013.01); *F25C 5/04* (2013.01); *F25C 5/22* (2018.01); *F25C 2400/06* (2013.01); *F25C 2400/10* (2013.01)

(58) Field of Classification Search
CPC ..... F25C 1/10; F25C 5/22; F25C 5/04; F25C 2400/06; F25C 2400/10; F25C 2305/0221
See application file for complete search history.

(56) References Cited

U.S. PATENT DOCUMENTS

2014/0013791 A1* 1/2014 Li ..... F25C 1/00 62/340

FOREIGN PATENT DOCUMENTS

CN 101149207 A 3/2008
CN 102305507 A 1/2012
(Continued)

OTHER PUBLICATIONS

ISR mailed Jul. 29, 2022 for PCT Application No. PCT/CN2021/143767.
(Continued)

*Primary Examiner* — Cassey D Bauer

(57) ABSTRACT

An ice-making device and a refrigeration machine are provided. The ice-making device includes a bracket, provided with a plurality of ice-making boxes; an operating member, mounted on the bracket; and a connector, connected between the operating member and the plurality of ice-making boxes to facilitate the operating member to drive the plurality of ice-making boxes to act; where the connector is provided with a plurality of releasing holes and limiting holes being in one-to-one correspondence with the operating
(Continued)

member and the plurality of ice-making boxes and communicating with each other; the connector is switched between a releasing position at which the operating member and the plurality of ice-making boxes are respectively connected to the releasing holes and are disassembled from the releasing holes, and a limiting position at which the operating member and the plurality of ice-making boxes are respectively connected to the limiting holes.

15 Claims, 7 Drawing Sheets

(56) References Cited

FOREIGN PATENT DOCUMENTS

| | | | |
|---|---|---|---|
| CN | 102353195 | A | 2/2012 |
| CN | 102788464 | A | 11/2012 |
| CN | 103712390 | A | 4/2014 |
| CN | 104748468 | A | 7/2015 |
| CN | 109579407 | A | 4/2019 |
| EP | 3889525 | A1 | 10/2021 |
| JP | 2000220927 | A | 8/2000 |
| JP | 2000346506 | A | 12/2000 |
| JP | 2000346509 | A | 12/2000 |
| WO | 2021179650 | A1 | 9/2021 |

OTHER PUBLICATIONS

EESR received in EP Application No. 21939587.8; mailed Nov. 17, 2023.

Supplementary search report received in CN Application No. 202111408553.7; mailed May 11, 2024.

Second OA received in CN Application No. 202111408553.7; mailed May 15, 2024.

* cited by examiner

ICE-MAKING DEVICE AND REFRIGERATION MACHINE

CROSS-REFERENCES TO RELATED APPLICATIONS

The present disclosure is a national phase application of International Application No. PCT/CN2021/143767, filed on Dec. 31, 2021, which claims priority to Chinese Patent Applications No. 202111408552.2, filed on Nov. 19, 2021, and No. 202111408553.7, filed on Nov. 19, 2021, the entireties of which are herein incorporated by reference.

FIELD

The present application relates to the field of ice-making, in particular to an ice-making device and a refrigeration machine.

BACKGROUND

In related arts, ice-making devices are mainly used for preparation of ice cubes, de-icing and storage. De-icing is usually performed by using gear and rack transmission modes, which enables the gear and rack transmission modes to be very complicated. Also, for an ice-making device with a plurality of ice-making boxes, each ice-making box performs de-icing independently, which brings inconvenience to users. Moreover, in order to ensure the stability of the transmission and linkage structure of the ice-making boxes, some ice-making boxes are not detachable and some ice-making boxes need to be disassembled using professional tools. After the ice-making device is used for a period of time, in order to keep the ice-making boxes clean, the user needs to disassemble the ice-making device to clean the ice-making boxes, which causes certain inconvenience by the above two installation methods.

SUMMARY

The present application is intended to solve at least one of the problems in the related art. Therefore, the present application provides an ice-making device capable of improving the de-icing efficiency of ice-making boxes.

The present application further provides refrigeration machine.

The ice-making device according to an embodiment of the present application includes:

a bracket, provided with a plurality of ice-making boxes;

an operating member, mounted on the bracket; and a connector, connected between the operating member and the plurality of ice-making boxes to facilitate the operating member to drive the plurality of ice-making boxes to act; where the connector is provided with a plurality of releasing holes and limiting holes being in one-to-one correspondence with the operating member and the plurality of ice-making boxes and communicating with each other; the connector is switched between a releasing position at which the operating member and the plurality of ice-making boxes are respectively connected to the releasing holes and are disassembled from the releasing holes, and a limiting position at which the operating member and the plurality of ice-making boxes are respectively connected to the limiting holes.

In the ice-making device according to the embodiments of the present application, the operating member and the plurality of ice-making boxes are connected by using a connector, while a plurality of releasing holes and limiting holes communicating with each other are arranged on the connector, and the connector can be switched between the releasing position and the limiting position. When the connector is at the releasing position, the operating member and the plurality of ice-making boxes are connected to the releasing holes and can act axially relative to the releasing holes to release from the releasing holes, and thus the operating member and the plurality of ice-making boxes can be disassembled along the axial direction of the releasing holes. When the connector is at the limiting position, the operating member and the plurality of ice-making boxes are connected to the limiting holes, and thus the connector can be axially limited, and thus the operating member and the plurality of ice-making boxes can be mounted in a linkage manner. In this way, the user only needs to adjust the position of the connector to disassemble and assemble the operating member and the plurality of ice-making boxes, which improves the disassembly and assembly efficiency of the ice-making boxes and is convenient for the user to clean the plurality of ice-making boxes. In addition, by connecting the plurality of ice-making boxes to the operating member through the connector, the user can invert the plurality of ice-making boxes only by rotating the operating member, the steps of de-icing for each ice-making box separately in the related art are eliminated, and the de-icing efficiency of the plurality of ice-making boxes is improved.

In an embodiment of the present application, the bracket includes a panel and a frame connected to the panel, where the operating member is rotatably connected to the panel, and the plurality of ice-making boxes are rotatably connected to the frame.

In an embodiment of the present application, an aperture of each of the releasing holes is larger than an aperture of each of the limiting holes, and a transition section is provided between each of the releasing holes and each of the limiting holes, and an aperture at the transition section is smaller than an aperture of the limiting hole.

In an embodiment of the present application, each ice-making box is provided with a second connecting column which includes a second connecting section and a second limiting section. A diameter of the second connecting section is matched with an aperture of the releasing hole, and a diameter of the second limiting section is matched with an aperture of the limiting hole.

In an embodiment of the present application, the second limiting section is provided with a second transition surface for passing the second limiting section through the transition section.

In an embodiment of the present application, two opposite ends of the frame are provided with a plurality of assembly holes configured to mount the plurality of ice-making boxes, and the plurality of ice-making boxes are provided with installation columns configured to install in the plurality of assembly holes.

In an embodiment of the present application, the frame is provided with a stopper bar, and the stopper bar abuts against ice trays of the plurality of ice-making boxes to limit a swivel angle of the plurality of ice-making boxes relative to the frame.

In an embodiment of the present application, each installation column is sleeved with a reset member configured to switch the plurality of ice-making boxes from a de-icing state to an ice-making state, and two ends of the reset member abut against the plurality of ice-making boxes and the frame, respectively.

In an embodiment of the present application, the operating member is provided with a first connecting column comprising a first connecting section and a first limiting section. A diameter of the first connecting section is matched with an aperture of the releasing hole, and a diameter of the first limiting section is matched with an aperture of the limiting hole.

In an embodiment of the present application, the first limiting section is provided with a first transition surface for passing the first limiting section through the transition section.

In an embodiment of the present application, the panel is provided with a through hole and a guide groove, where the operating member is provided with a connecting head in rotation-match with the through hole, and the first connecting column is adapted to pass through the guide groove to connect to the connector.

In an embodiment of the present application, the ice making device further includes an ice storage box arranged below the bracket and corresponding to the plurality of ice-making boxes.

In an embodiment of the present application, the ice making device further includes a housing, and the bracket and the ice storage box are movably mounted on the housing.

The refrigeration machine according to an embodiment of the present application, includes a cabinet body and the ice-making device mentioned above, and the ice-making device is arranged in the cabinet body.

According to the refrigeration machine provided by the embodiments of the present application, the de-icing efficiency of the ice-making box can be improved by arranging the ice-making device mentioned above in the cabinet body, and it is convenient for the user to assemble and disassemble the plurality of ice-making boxes to facilitate the user to clean the plurality of ice-making boxes.

One or more solutions according to the embodiments of the present application have at least one of the following beneficial effects.

In the ice-making device according to the embodiments of the present application, the operating member and the plurality of ice-making boxes are connected by using a connector, while a plurality of releasing holes and limiting holes communicating with each other are arranged on the connector, and the connector can be switched between the releasing position and the limiting position. When the connector is at the releasing position, the operating member and the plurality of ice-making boxes are connected to the releasing holes and can act axially relative to the releasing holes to loose from the releasing holes, and thus the operating member and the plurality of ice-making boxes can be disassembled along the axial direction of the releasing holes. When the connector is at the limiting position, the operating member and the plurality of ice-making boxes are connected to the limiting holes, and thus the connector can be axially limited, and thus the operating member and the plurality of ice-making boxes can be mounted in a linkage manner. In this way, the user only needs to adjust the position of the connector to disassemble and assemble the operating member and the plurality of ice-making boxes, which improves the disassembly and assembly efficiency of the ice-making boxes and is convenient for the user to clean the plurality of ice-making boxes. In addition, by connecting the plurality of ice-making boxes to the operating member through the connector, the user can invert the plurality of ice-making boxes only by rotating the operating member, the steps of de-icing for each ice-making box separately in the related art are eliminated, and the de-icing efficiency of the plurality of ice-making boxes is improved.

Further, according to the refrigeration machine provided by the embodiments of the present application, the de-icing efficiency of the ice-making box can be improved by arranging the ice-making device mentioned above in the cabinet body, and it is convenient for the user to assemble and disassemble the ice-making box to facilitate the user to clean the ice-making box.

Additional aspects and advantages of the present application are set forth, in part, from the following description, and the part will become clear from the following description, or is learned by practice of the present application.

BRIEF DESCRIPTION OF THE DRAWINGS

In order to more clearly illustrate the solutions according to the present application or the related art, the accompanying drawings used in the description of the embodiments of the present application or the related art will be briefly introduced below. It should be noted that the drawings in the following description are only part embodiments of the present application. For those of ordinary skill in the art, other drawings can also be obtained according to these drawings without creative efforts.

REFERENCE NUMERALS

Figure 1:
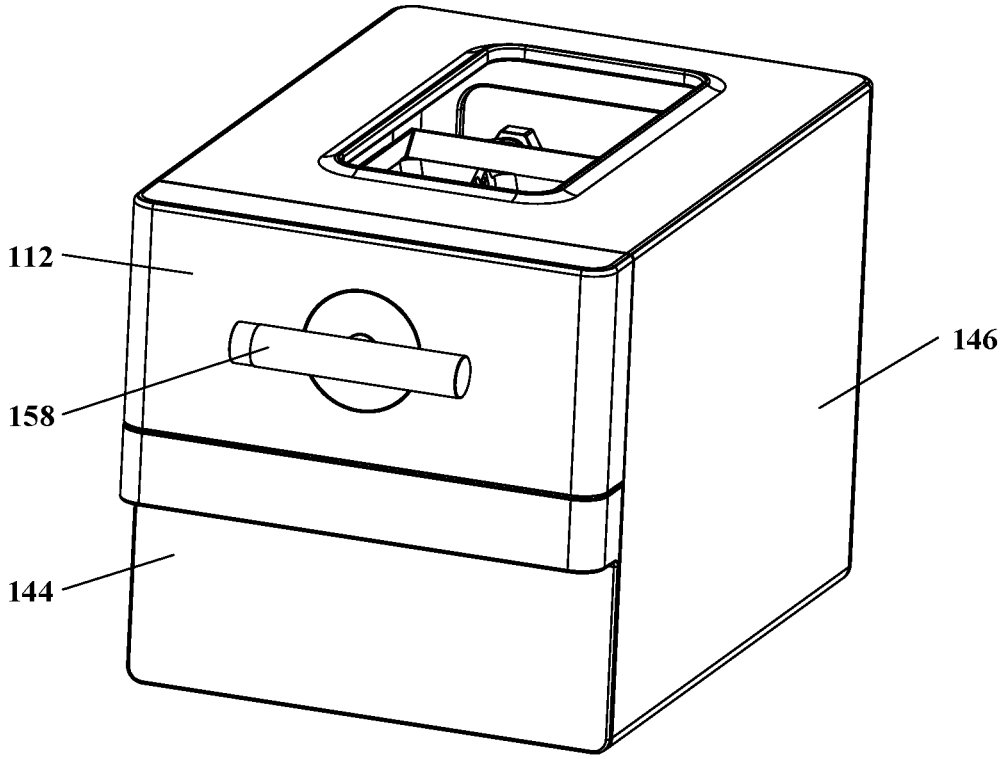
FIG. 1 is a schematic structural diagram of an ice-making device according to an embodiment of the present application.

100: bracket; 102: ice-making box; 104: operating member; 106: connector; 108: releasing hole; 110: limiting hole; 112: panel; 114: frame; 116: transition section; 118: first connecting column; 120: first connecting section; 122: first limiting section; 124: first transition surface; 126: through hole; 128: guide groove; 130: connecting head; 132: second connecting column; 134: second connecting section; 136: second limiting section; 138: second transition surface; 140: assembly hole; 142: installation column; 144: ice storage box; 146: housing; 148: torsion spring; 150: stopper bar; 152: supporting structure; 154: limiting protrusion; 156: limiting boss; 158: handle structure.

DETAILED DESCRIPTION OF THE DISCLOSURE

The implementation of the present application is further described in detail below in combination with the accompanying drawings and embodiments. The following embodiments are used to describe the present application, but cannot be used to limit the scope of the present application.

In the description of the present application, it is to be noted that, the orientation or positional relations specified by terms such as "central", "longitudinal", "transverse", "upper", "lower", "front", "back", "left", "right", "vertical", "horizontal", "top", "bottom", "inner", "outer" and the like, are based on the orientation or positional relations shown in the drawings, which is merely for convenience of description of the present application and to simplify description, but does not indicate or imply that the stated devices or components must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the level height of the first feature is higher than level height of the second feature. The first feature is "under", "below" and "beneath" the second feature can refer to that the first feature is directly below or obliquely below the second feature, or simply refer to that the level height of the first feature is lower than level height of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art may combine the different embodiments or examples described in this specification, as well as the features of the different embodiments or examples, without conflicting each other.

As shown in FIG. 1 to FIG. 12, an embodiment of the present application provides an ice-making device, including a bracket 100, an operating member 104 and a connector 106; where the bracket 100 is provided with a plurality of ice-making boxes 102; the operating member 104 is mounted on the bracket 100; and the connector 106 is connected between the operating member 104 and the plurality of ice-making boxes 102 and thus the operating member 104 drives the plurality of ice-making boxes 102 to act; where the connector 106 is provided with a plurality of releasing holes 108 and limiting holes 110 being in one-to-one correspondence with the operating member 104 and the plurality of ice-making boxes 102 and communicating with each other; the connector 106 is switched between a releasing position at which the operating member 104 and the plurality of ice-making boxes 102 are respectively connected to the releasing holes 108 and are disassembled from the releasing holes 108, and a limiting position at which the operating member 104 and the plurality of ice-making boxes 102 are respectively connected to the limiting holes 110.

In the ice-making device provided by the embodiments of the present application, the operating member 104 and the plurality of ice-making boxes 102 are connected by using a connector 106, while a plurality of releasing holes 108 and limiting holes 110 communicating with each other are arranged on the connector 106, and the connector 106 can be switched between the releasing position and the limiting position. When the connector 106 is at the releasing position, the operating member 104 and the plurality of ice-making boxes 102 are connected to the releasing holes 108 and can act axially relative to the releasing holes 108 to release from the releasing holes 108, and thus the operating member 104 and the plurality of ice-making boxes 102 can be disassembled along the axial direction of the releasing holes 108. When the connector 106 is at the limiting position, the operating member 104 and the plurality of ice-making boxes 102 are connected to the limiting holes 110, and thus the connector 106 can be axially limited, and thus the operating member 104 and the plurality of ice-making boxes 102 can be mounted in a linkage manner. In this way, the user only needs to adjust the position of the connector 106 to disassemble and assemble the operating member 104 and the plurality of ice-making boxes 102, which improves the disassembly and assembly efficiency of the ice-making boxes 102 and is convenient for the user to clean the plurality of ice-making boxes 102. In addition, by connecting the plurality of ice-making boxes 102 to the operating member 104 through the connector 106, the user can invert the plurality of ice-making boxes 102 only by rotating the operating member 104, the steps of de-icing for each ice-making box 102 separately in the related art are eliminated, and the de-icing efficiency of the plurality of ice-making boxes 102 is improved.

In an embodiment of the present application, the operating member 104 and the plurality of ice-making boxes 102 are mounted on the bracket 100 by using the connector 106, while a plurality of releasing holes 108 and limiting holes 110 communicating with each other are arranged on the connector 106, and the connector 106 can be switched between the releasing position and the limiting position. When the connector 106 is at the releasing position, the operating member 104 and the plurality of ice-making boxes 102 are connected to the releasing holes 108 and can act axially relative to the releasing holes 108 to release from the releasing holes 108, and thus the operating member 104 and the plurality of ice-making boxes 102 can be disassembled along the axial direction of the releasing holes 108. When the connector 106 is at the limiting position, the operating member 104 and the ice-making boxes 102 are connected to the limiting holes 110, and thus the operating member 104 and the ice-making boxes 102 can be mounted in a linkage manner. In this way, the user only needs to adjust the position of the connector 106 to disassemble and assemble the operating member 104 and the ice-making boxes 102, which improves the disassembly and assembly efficiency of the ice-making boxes 102 and is convenient for the user to clean the ice-making boxes 102. In addition, the number of ice-making boxes 102 is plurality, and the plurality of ice-making boxes 102 can be connected to the connector 106. In this case, the plurality of ice-making boxes 102 can be inverted only by the connector 106, and thus de-icing is performed efficiently.

The ice-making device according to the present application mainly includes a bracket 100, an operating member 104 and a connector 106. The bracket 100 is used to support the ice-making boxes 102 and mount the operating member 104. The operating member 104 is used to facilitate the user to swivel and de-ice the ice-making boxes 102. The connector 106 is used to connect the operating member 104 and the plurality of ice-making boxes 102 and thus the operating member 104 can simultaneously drive the plurality of ice-making boxes 102 for de-icing.

Figure 3:
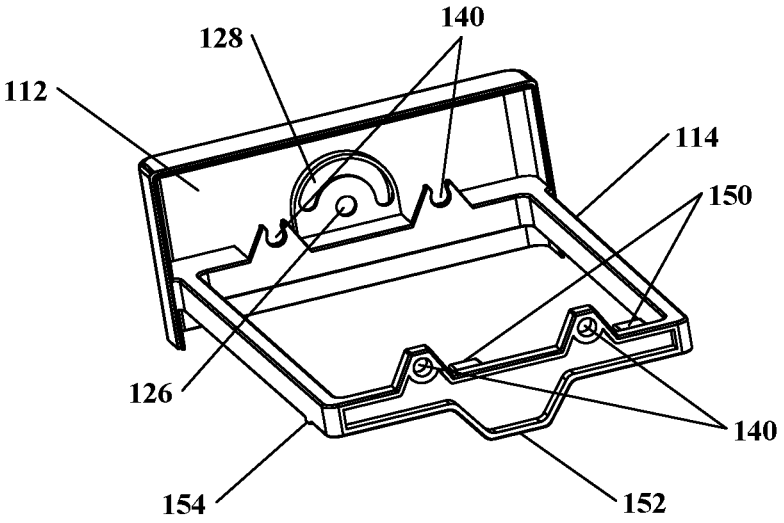
FIG. 3 is a schematic structural diagram of a bracket according to an embodiment of the present application.

In an embodiment of the present application, as shown in FIG. 3, the bracket 100 includes a panel 112 and a frame 114 connected to the panel 112, where the frame 114 is roughly a rectangular and mounted on a side of the panel 112. The operating member 104 is rotatably connected to the panel 112, the number of the ice-making boxes 102 is plurality, and the plurality of ice-making boxes 102 are rotatably connected to the frame 114.

As shown in FIG. 3, the panel 112 is provided with a through hole 126, and the operating member 104 is provided with a connecting head 130 in rotation-match with the through hole 126. An end of the connecting head 130 on the operating member 104 is provided with one or more claws. When the connecting head 130 is inserted into the through hole 126, the claws at the end of the connecting head 130 can be clamped to an outer end surface of the through hole 126 on the panel 112, thereby realizing the rotation connection between the operating member 104 and the panel 112.

As mentioned above, in order to facilitate de-icing, the plurality of ice-making boxes 102 can swivel relative to the frame 114. For example, the number of the ice-making boxes 102 is two and the two ice-making boxes 102 are arranged side by side on the frame 114 and can swivel relative to the frame 114. In order to mount the ice-making boxes 102, two opposite ends of the frame 114 are provided with assembly holes 140 used for mounting the ice-making boxes 102. As shown in FIG. 3, the assembly holes 140 can be provided at an end of the frame 114 proximal to the panel 112 and an end of the frame 114 away from the panel 112. In addition, in order to conveniently mount the ice-making boxes 102 on the frame 114 or detach it from the frame 114, the assembly hole 140 on the end of the frame 114 proximal to the panel 112 is an assembly hole 140 with an opening, and the assembly hole 140 on the end of the frame 114 away from the panel 112 is a fully closed assembly hole 140. Correspondingly, two opposite ends of the ice-making boxes 102 are provided with installation columns 142 used for installing in the assembly hole 140.

When it is needed to mount the ice-making boxes 102 on the frame 114, the installation column 142 at an end of the ice-making boxes 102 can be inserted into the fully closed assembly hole 140, and then the installation column 142 at another end of the ice-making boxes 102 can be inserted into the assembly hole 140 with an opening. In this way, the convenience of mounting the ice-making boxes 102 on the frame 114 can be improved, and the deformation of the ice-making boxes 102 can be reduced, and the fully closed assembly hole 140 can effectively prevent the installation column 142 from falling out.

When it is needed to detach the ice-making boxes 102 from the frame 114, the installation column 142 located in the assembly hole 140 with an opening can be taken out first, and then the installation column 142 in the fully closed assembly hole 140 can be taken out.

In order to limit the position of the ice-making boxes 102 on the frame 114, an end of the installation column 142 is provided with a limiting boss 156. An axial action of the ice-making boxes 102 relative to the assembly hole 140 can be limited by abutting the limiting boss 156 against an end surface of the assembly hole 140 with an opening.

In other embodiments, all assembly holes 140 can be set as fully closed assembly holes 140, or all assembly holes 140 can be set as assembly holes 140 with opening.

When the ice-making boxes 102 needs to be de-iced, in order to limit the swivel of the ice-making boxes 102, an end of the frame 114 away from the panel 112 is provided with stopper bars 150, and for example, the stopper bars 150 can be provided on an inner wall of the frame 114. In this case, when the ice-making boxes 102 swivels, the outer wall of the ice trays on the ice-making boxes 102 can abut against the stopper bar 150 to limit the swivel angle of the ice-making boxes 102. It should be noted that the number of the stopper bars 150 corresponds to the number of the ice-making boxes 102. After the stopper bars 150 abut against the outer wall of the ice trays of the ice-making boxes 102, the user continues to swivel the operating member 104, and thus the ice-making boxes 102 continues to twist to make the ice in each ice tray of the ice-making boxes 102 fall off. Therefore, the ice-making boxes 102 can be made of materials with certain deformation, such as polypropylene, acrylonitrile, butadiene, styrene three monomers of terpolymer or engineering plastics, etc.

In addition, in order to automatically reset the ice-making boxes 102, that is, to switch the ice-making boxes 102 from the de-icing state to the ice-making state, the installation column 142 of each ice-making box 102 is sleeved with a reset member. The reset member can be a torsion spring 148, where an end of the torsion spring 148 abuts tightly against the ice-making box 102, and another end of the torsion spring 148 abuts tightly against the frame 114. For example, an end of the torsion spring 148 can abut tightly against the bottom of the ice-making box 102, and the another end of the torsion spring 148 can abut tightly against the stopper bar 150. It should be noted here that in order to abut tightly the another end of the torsion spring 148, two stopper bars 150 can be arranged along the height direction of the frame 114, and the another end of the torsion spring 148 can be bent to form a bending section capable of being inserted a gap between the two stopper bars 150. In this case, when the user swivels the operating member 104, the operating member 104 can drive the ice-making boxes 102 to be switched from the ice-making state to the de-icing state through the connector 106. After the de-icing operation is completed, the ice-making boxes 102 can be switched from the de-icing state to the ice-making state under the elastic restoring force of the torsion spring 148.

In other embodiments, the torsion spring 148 is not essential and the ice-making boxes 102 can be de-iced and reset only by the user swivels the operating member 104.

The bottom of one end of the frame 114 away from the panel 112 is provided with a supporting structure 152, where the bottom of the supporting structure 152 is flush with the bottom of the panel 112. In this case, when the user removes the bracket 100 and pours water to the ice-making boxes 102, the bracket 100 can be stably placed on a table through being supported by the bottom of the panel 112 and the bottom of the supporting structure 152 to prevent water overflow.

In other embodiments, when it is needed to pour water to the ice-making boxes 102, water can be injected into the ice-making box 102 through the water injection hole at the top of the housing 146, which saves the step of taking out the ice-making box 102 and improves the ice-making efficiency.

Figure 2:
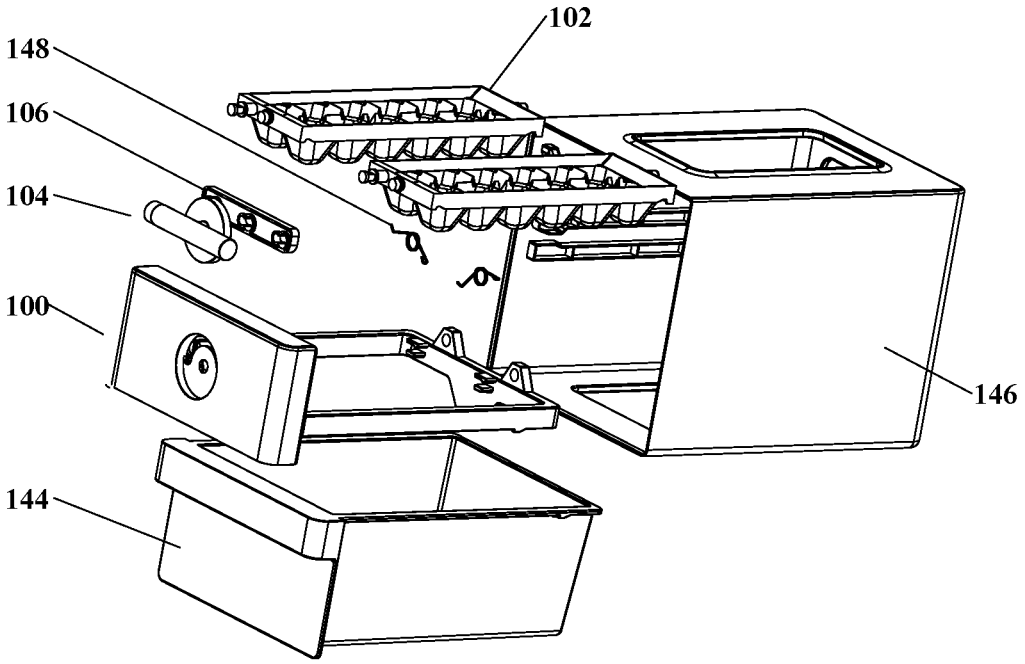
FIG. 2 is a schematic exploded view of an ice-making device according to an embodiment of the present application.

Referring to FIG. 1 and FIG. 2, according to an embodiment of the present application, the ice-making device further includes ice storage box 144 arranged below the bracket 100 and corresponding to the ice-making boxes 102.

The ice storage box 144 and the bracket 100 are independent to each other, and thus the user can take out the ice storage box 144 separately. When the ice-making box 102 is de-iced, the ice made in the ice-making box 102 can directly fall into the ice storage box 144 with the swivel of the ice-making box 102. In addition, in order to facilitate the user's observation to the quantity of ice in the ice storage box 144, the ice storage box 144 can be made of transparent materials. In addition, a pulling slot can be provided on the ice storage box 144 to facilitate the user to pull out the ice storage box 144.

Referring to FIG. 1 and FIG. 2, according to an embodiment of the present application, the ice-making device further includes a housing 146, where the bracket 100 and the ice storage box 144 are movably arranged in the housing 146.

By providing the housing 146 and arranging the bracket 100 and the ice storage box 144 in the housing 146, it is convenient for users to carry them. In order to pull out and push back the bracket 100 and the ice storage box 144 conveniently, a corresponding slide rail or chute can be provided inside the housing 146. An edge of the bracket 100 and an edge of the ice storage box 144 can be directly arranged on the slide rail or inserted in the chute, which can reduce the resistance of the bracket 100 and the ice storage box 144 during the pull-out and push-back process and improve the user's convenience.

It should be noted here that in most situations, it is unnecessary to completely detach the bracket 100 from the housing 146. Therefore, in order to avoid complete removal of the bracket 100 from the housing 146, referring to FIG. 3, the bottom of the frame 114 can be provided with a limiting protrusion 154, which can ensure that the frame 114 is not easy to slip from the housing 146 when the ice-making device is tilted. Further, by arranging the limiting protrusion 154 at the bottom of the frame 114, it is also possible to reduce the friction between the frame 114 and the slide rail or chute in the housing 146, and facilitate the user to pull the frame 114.

In an embodiment of the present application, the operating member 104 and the ice-making box 102 is connected by relying on the connector 106. That is, the connector 106 is arranged between the operating member 104 and the ice-making box 102, and the operating member 104 and the ice-making box 102 can be assembled and disassembled through the cooperation of the connector 106 and the bracket 100.

A plurality of releasing holes 108 and limiting holes 110 communicating with each other are arranged on the connector 106. It should be noted that both the operating member 104 and the ice-making boxes 102 are connected to the connector 106. Therefore, the numbers of releasing holes 108 and the limiting holes 110 on the connector 106 correspond to the number of the operating members 104 and the ice-making boxes 102. For example, the number of the ice-making boxes 102 is two, the number of the operating member 104 is one, and the number of the corresponding releasing holes 108 and the limiting holes 110 are three, respectively.

In an embodiment the present application, the connector 106 can be switched between the releasing position and the limiting position. When the connector 106 is at the releasing position, the operating member 104 and the ice-making boxes 102 are respectively installed in the corresponding releasing holes 108 on the connector 106, and both the operating member 104 and the ice-making boxes 102 can be disassembled from the bracket 100. When the connector 106 is at the limiting position, the operating member 104 and the ice-making boxes 102 are installed in the corresponding limiting holes 110 on the connector 106, the axial movement of the connector 106 is limited, and the operating member 104 and the ice-making boxes 102 are mounted on the bracket 100.

The function of the connector 106 is described below in combination with a specific structure of the connector 106.

Figure 5:
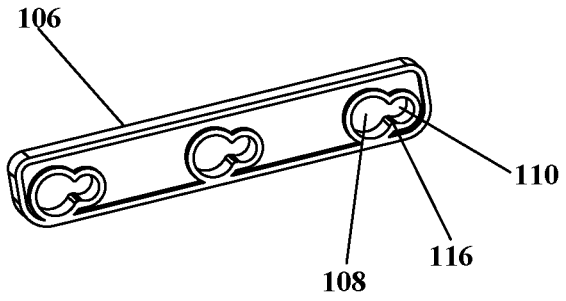
FIG. 5 is a schematic structural diagram of a connector according to an embodiment of the present application.
Figure 12:
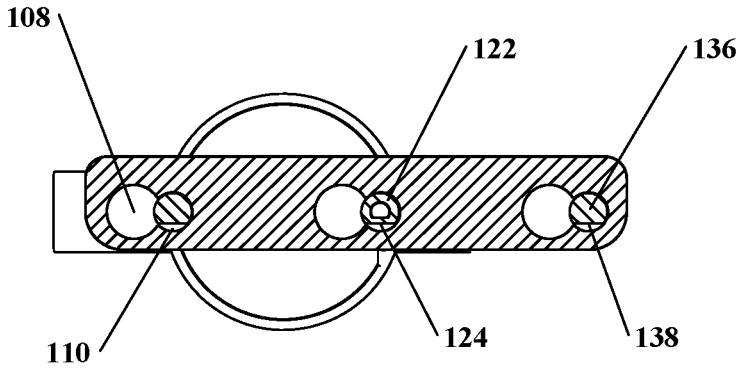
FIG. 12 is a schematic sectional view of an A-A direction in FIG. 11.

Referring to FIG. 5 and FIG. 12, in an embodiment of the present application, the aperture of the releasing hole 108 on the connector 106 is larger than the aperture of the limiting hole 110 on the connector 106, and a transition section 116 is formed between the releasing hole 108 and the limiting hole 110. The aperture of the transition section 116 is smaller than the aperture of the limiting hole 110.

In an embodiment, the releasing hole 108 and the limiting hole 110 on the connector 106 can form a structure similar to a gourd hole. The aperture of the releasing hole 108 is larger than the aperture of the limiting hole 110, and a transition section 116 is arranged between the releasing hole 108 and the limiting hole 110 to form the transition between the releasing hole 108 and the limiting hole 110. Since the releasing hole 108 and the limiting hole 110 communicate with each other, the transition section 116 has a certain aperture, and the aperture of the transition section 116 is smaller than the aperture of the limiting hole 110. Thus, when the operating member 104 and the ice-making box 102 are installed in the releasing hole 108, both the operating member 104 and the ice-making box 102 are able to move in the axial direction of the releasing hole 108 relative to the connector 106 so that the user can detach the operating member 104 and the ice-making box 102 from the bracket 100. When the operating member 104 and the ice-making box 102 are installed in the limiting hole 110, the operating member 104 and the ice-making box 102 can be limited by the limiting hole 110, and thus the operating member 104 and the ice-making box 102 are limited in the limiting hole 110.

Figure 4:
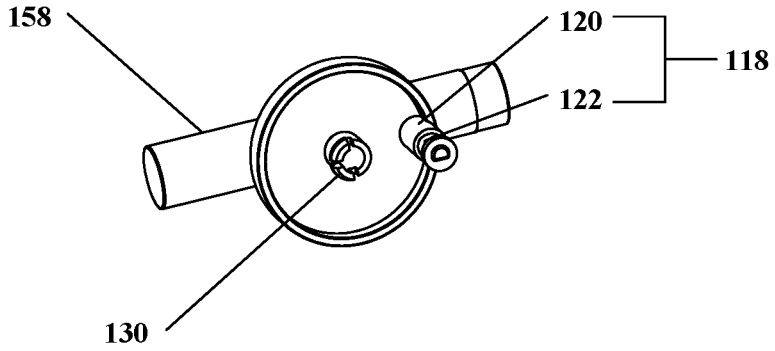
FIG. 4 is a schematic structural diagram of an operating member according to an embodiment of the present application.

Referring to FIG. 4, in order to achieve the above purpose, the operating member 104 is provided with a first connecting column 118. The first connecting column 118 includes a first connecting section 120 and a first limiting section 122. The diameter of the first connecting section 120 is matched with the aperture of the releasing hole 108, and the diameter of the first limiting section 122 is matched with the aperture of the limiting hole 110.

In an embodiment, the first connecting column 118 for connecting the connector 106 is arranged at the side of the operating member 104 with the connecting head 130. The first connecting column 118 is not a complete cylindrical section structure. The root of the first connecting column 118 is a complete cylindrical section, which is part of the first connecting section 120. The diameter of the first connection section 120 is equal to or slightly less than the aperture of the releasing hole 108, but it is necessary to ensure that the diameter of the first connection section 120 is greater than the aperture of the limiting hole 110. A cylindrical section with a slightly smaller diameter is arranged upward from the first connecting section 120, which is the first limiting section 122, and the diameter of the first limiting section 122 is equal to or slightly less than the aperture of the limiting hole 110. A complete cylindrical section is arranged upward from the first limiting section 122, which is another part of the first connecting section 120.

In this case, when the connector 106 is at the releasing position, the first connecting column 118 on the operating member 104 is aligned with the releasing hole 108 on the connector 106. Since the diameter of the first connecting section 120 on the first connecting column 118 is equal to or slightly smaller than the aperture of the releasing hole 108, the operating member 104 can move along the axial direction of the releasing hole 108 and the user can detach the operating member 104 from the panel 112 only by taking out the operating member 104 along the axial direction of the releasing hole 108. When the connector 106 is at the limiting position, since the operating member 104 is fixed by the panel 112 on the bracket 100, the position of the first connecting column 118 is fixed. By pushing the connector 106, the first connecting column 118 can slide into the limiting hole 110 from the releasing hole 108. Since both ends of the first limiting section 122 are provided with the first connecting section 120 having a diameter greater than the aperture of the limiting hole 110, the axial movement of the first connecting column 118 relative to the limiting hole 110 is limited, thereby limiting the axial movement of the connector 106.

Referring to FIG. 12, as mentioned above, since a transition section 116 is arranged between the releasing hole 108 and the limiting hole 110 and the aperture of the transition section 116 is smaller than the aperture of the limiting hole 110, in order to ensure that the first connecting column 118 can smoothly slide from the releasing hole 108 into the limiting hole 110, the first limiting section 122 is provided with a first transition surface 124 used for passing the first limiting section 122 through the transition section 116.

The first transition surface 124 mentioned here can be any one of the plane and wavy surfaces. The maximum size between the first transition surface 124 and the outer side of the first limiting section 122 is larger than the aperture of the transition section 116. In an embodiment, the first limiting section 122 is clipped into the limiting hole 110 after passing through the transition section 116 by means of interference fit, which can prevent the first limiting section 122 from sliding out of the limiting hole 110.

It should be noted that in order to prevent the first connecting column 118 from disengaging from the limiting hole 110 during the de-icing process, the first transition surface 124 needs to be swiveled in a direction away from the transition section 116. As shown in FIG. 12, for example, the first connecting column 118 swivels counterclockwise to de-ice, and correspondingly, the first transition surface 124 is arranged in the downward direction on the first limiting section 122. If the first connecting column 118 swivels clockwise to de-ice, the first transition surface 124 should be arranged in the upward direction on the first limiting section 122. In this case, when the first connecting column 118 swivels, the first transition surface 124 swivels away from the transition section 116, so that the first connecting column 118 can be prevented from disengaging from the limiting hole 110.

Referring to FIG. 3, according to an embodiment of the present application, the panel 112 is provided with a guide groove 128, and the first connecting column 118 is adapted to pass through the guide groove 128 to be connected to the connector 106.

Since the swivel path of the first connecting column 118 is arc when the first connecting column 118 swivels, the guide groove 128 is an arc groove. By arranging the guide groove 128, it can provide guidance for the swivel of the first connecting column 118, which ensures the stability when the user turns the operating member 104. Further, by arranging the guide groove 128, when the user turns the operating member 104, the operating member 104 can take the connection head 130 as the center of a circle and the distance between the first connecting column 118 and the connection head 130 as the radius, to make that through the guidance of the guide groove 128, the user is more labor-saving for turning the operating member 104, and then the inversion operation of the ice-making box 102 can be completed to rapidly and effortlessly de-ice.

It should be noted that during the user turns the operating member 104, the operating member 104 only swivels with the connection head 130 as the center of the circle, while the first connecting column 118 swivels eccentrically with the swivel of the operating member 104 relative to the connection head 130. Due to the guiding effect of the guide groove 128 on the first connecting column 118, the motion path of the first connecting column 118 is limited, thereby achieving the labor-saving operation of de-icing.

Referring to FIG. 4, in an embodiment of the present application, in order to facilitate the user to hold, the operating member 104 is provided with a handle structure 158. In actual operation, the user can hold the handle structure 158 to apply greater torque to the ice-making box 102, thereby making the de-icing smoother.

Figure 6:
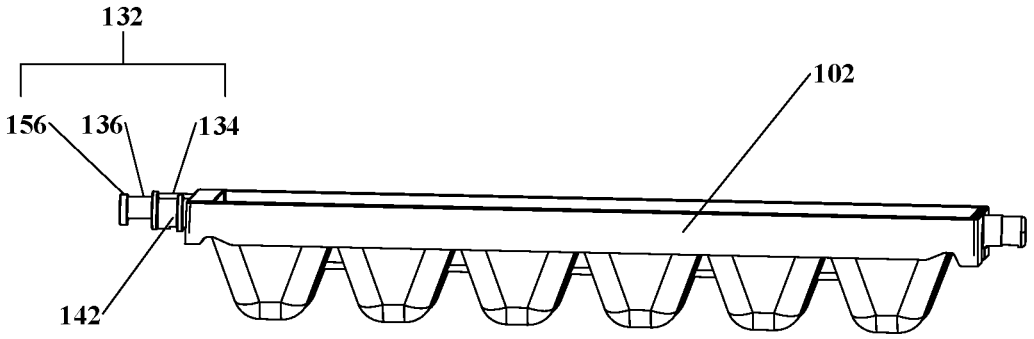
FIG. 6 is a schematic structural diagram of an ice-making box according to an embodiment of the present application.
Figure 7:
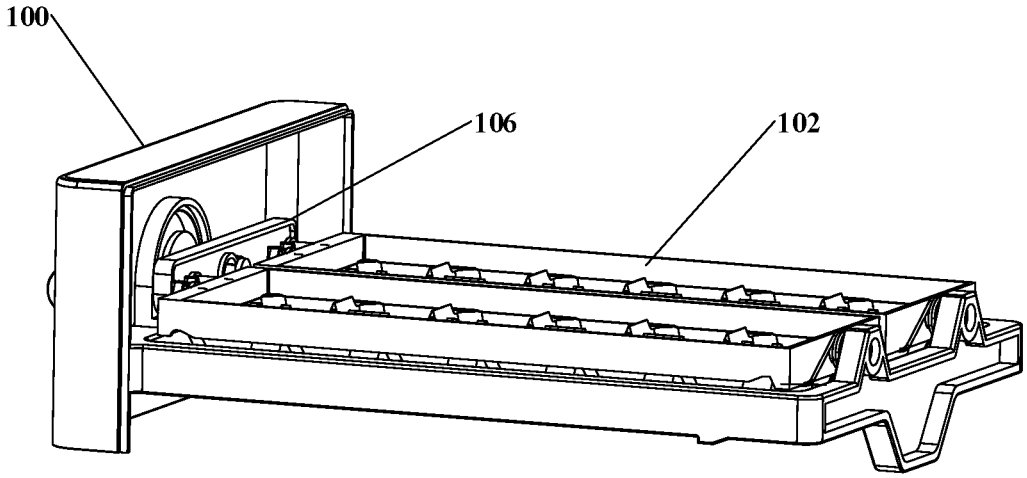
FIG. 7 is a schematic structural diagram of a bracket mounted with an ice-making box and an operating member in a bracket according to an embodiment of the present application.
Figure 8:
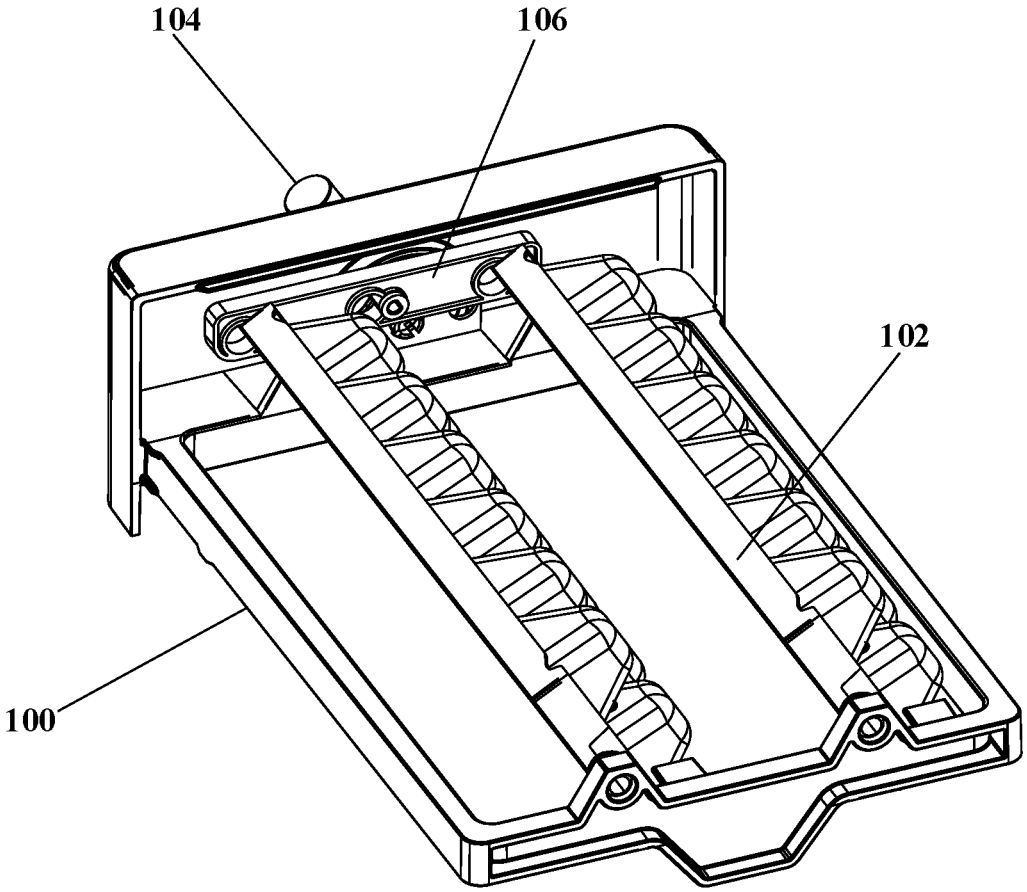
FIG. 8 is a schematic structural diagram of an ice-making box in a de-icing state according to an embodiment of the present application.
Figure 9:
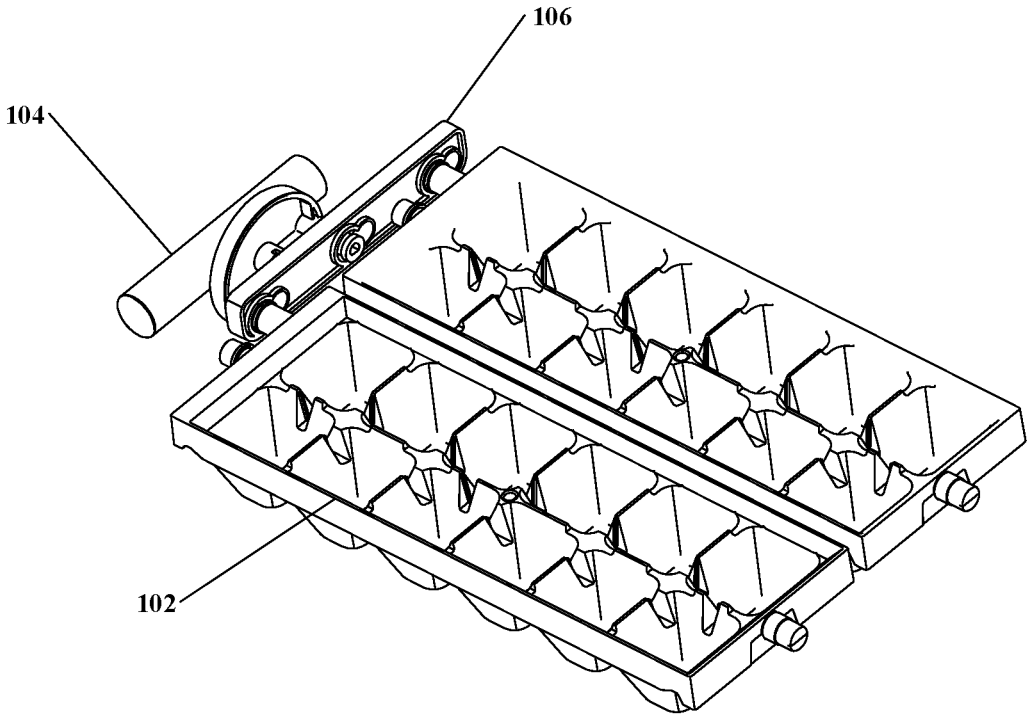
FIG. 9 is a schematic structural diagram in which an operating member and an ice-making box are located in a plurality of releasing holes according to an embodiment of the present application.
Figure 10:
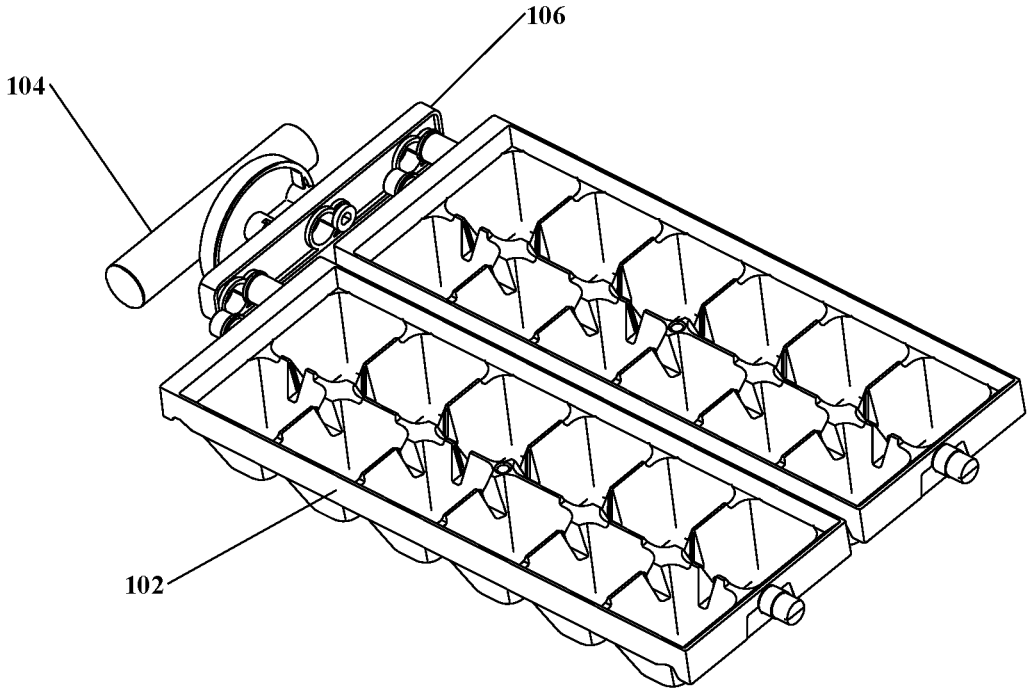
FIG. 10 is a schematic structural diagram in which an operating member and an ice-making box are located in a plurality of limiting holes according to an embodiment of the present application.
Figure 11:
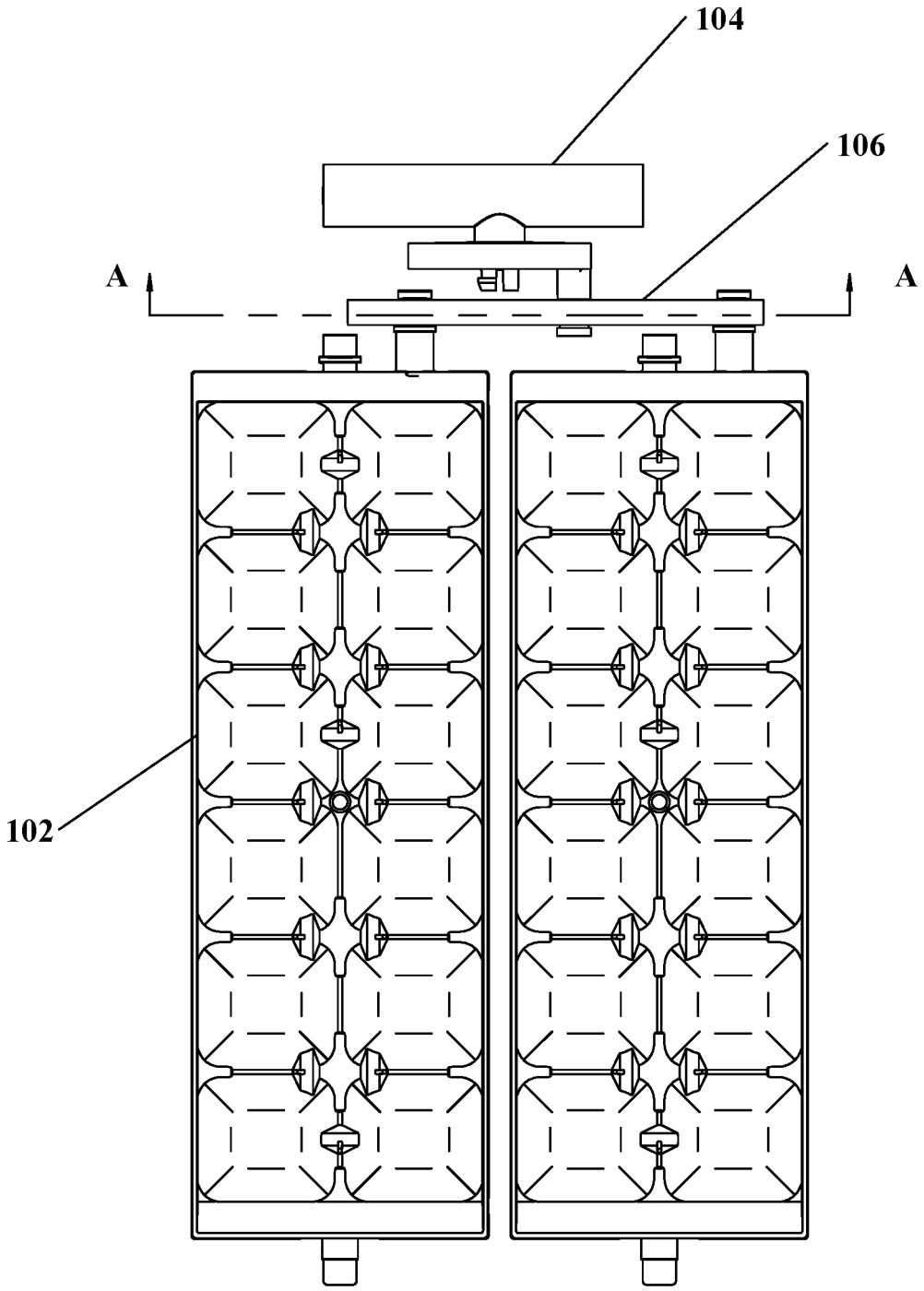
FIG. 11 is a schematic top view in which an operating member and an ice-making box are located in a plurality of limiting holes according to an embodiment of the present application.

Referring to FIG. 6, in order to disassemble and assemble the ice-making box 102 through the connector 106, an end of the ice-making box 102 facing the panel 112 is provided with a second connecting column 132. The second connecting column 132 includes a second connecting section 134 and a second limiting section 136. The diameter of the second connecting section 134 is matched with the aperture of the releasing hole 108, and the diameter of the second limiting section 136 is matched with the aperture of the limiting hole 110.

In an embodiment, the second connecting column 132 used for connecting the connector 106 is arranged at an end of the ice-making box 102 facing the panel 112 in the bracket 100. Similarly, the second connecting column 132 is not a complete cylindrical section structure. The root of the second connecting column 132 is a complete cylindrical section, which is part of the second connecting section 134. The diameter of the second connection section 134 is equal to or slightly less than the aperture of the releasing hole 108, but it is necessary to ensure that the diameter of the second connection section 134 is greater than the aperture of the limiting hole 110. A cylindrical section with a slightly smaller diameter is arranged upward from the second connecting section 134, which is the second limiting section 136. The diameter of the second limiting section 136 is equal to or slightly less than the aperture of the limiting hole 110. A complete cylindrical section is arranged upward from the second limiting section 136, which is another part of the second connecting section 134. That is, the structure of the second connecting column 132 arranged on the ice-making box 102 is exactly the same as the structure of the first connecting column 118 arranged on the operating member 104.

In this case, when the connector 106 is at the releasing position, the second connecting column 132 on the ice-making box 102 and the releasing hole 108 on the connector 106 are aligned with each other. Since the diameter of the second connecting section 134 on the second connecting column 132 is equal to or slightly smaller than the aperture of the releasing hole 108, the connector 106 can move along the axial direction of the releasing hole 108, and the user can detach the ice-making box 102 from the bracket 100 only by taking out the connector 106 along the axial direction of the releasing hole 108. When the connector 106 is at the limiting position, since the ice-making box 102 is fixed by the frame 114 on the bracket 100, the position of the second connecting column 132 is fixed. By pushing the connector 106, the second connecting column 132 can slide from the releasing hole 108 into the limiting hole 110. Since both ends of the second limiting section 136 are provided with the second connecting section 134 having a diameter greater than the aperture of the limiting hole 110, the axial motion of the second connecting column 132 relative to the limiting hole 110 is limited, which further limits the axial motion of the connector 106, and thus the connector 106, the operating member 104 and the ice-making box 102 are stably mounted.

Referring to FIG. 12, as mentioned above, since a transition section 116 is arranged between the releasing hole 108 and the limiting hole 110 and the aperture of the transition section 116 is smaller than the aperture of the limiting hole 110, in order to ensure that the second connecting column 132 can smoothly slide from the releasing hole 108 into the limiting hole 110, the second limiting section 136 is provided with a second transition surface 138 used for passing the second limiting section 136 through the transition section 116.

The second transition surface 138 mentioned here can be any one of the plane and wave surfaces. The maximum size between the second transition surface 138 and the outer side of the second limiting section 136 is larger than the aperture of the transition section 116. In an embodiment, the second limiting section 136 is clipped into the limiting hole 110 after passing through the transition section 116 by interference fit, which can prevent the second limiting section 136 from sliding out of the limiting hole 110.

It should be noted that in order to prevent the second connecting column 132 from disengaging from the limiting hole 110 during the de-icing process, the second transition surface 138 needs to be swiveled in a direction away from the transition section 116. As shown in FIG. 12, for example, the second connecting column 132 swivels counterclockwise to de-ice, and correspondingly, the second transition surface 138 is arranged in the downward direction on the second limiting section 136. If the second connecting column 132 swivels clockwise to de-ice, the second transition surface 138 should be arranged in upward direction on the second limiting section 136. In this case, when the second connecting column 132 swivels, the second transition surface 138 swivels away from the transition section 116, and thus the second connecting column 132 can be prevented from disengaging from the limiting hole 110.

The method for mounting the ice-making device provided by the embodiments of the present application is briefly described below.

The operating member 104 is clipped into the through hole 126 on the panel 112 through the connecting head 130, and the first connecting column 118 on the operating member 104 passes through the guide groove 128 on the panel 112 and is then inserted into the releasing hole 108 on the connector 106. The second connecting column 132 on the ice-making box 102 at the back end (an end away from the connector 106) is inserted into the closed assembly hole 140, and then the second connecting column 132 on the ice-making box 102 at the front end (an end proximal to the connector 106) is inserted into the open assembly hole 140. In addition, the second connecting column 132 located at the front end of the ice-making box 102 is inserted into the releasing hole 108 on both sides of the connector 106, and then sliding the connector 106 in a side direction so that the first limiting section 122 of the first connecting column 118 and the second limiting section 136 of the second connecting column 132 are respectively clipped into the limiting holes 110 corresponding to the connector 106 by interference fit to complete the assembly. Then by turning the operating member 104, the two ice-making boxes 102 can be inverted through the leading of the connector 106 to complete the de-icing operation.

The disassembly and assembly method of the ice-making device according to the embodiments of the present application is briefly described below.

By sliding the connector 106 reversely, the first limiting section 122 of the first connecting column 118 and the second limiting section 136 of the second connecting column 132 slide into the corresponding releasing holes 108 on the connector 106, respectively. At this time, the operating member 104 can be disassembled from the panel 112 along the axial direction of the connector 106, and the ice-making box 102 can be disassembled along the axial direction of the second connecting column 132, while the connector 106 can also be removed.

An embodiment of the present application provides a refrigeration machine, including a cabinet body and the ice-making device mentioned above, where the ice-making device is arranged in the cabinet body.

According to the refrigeration machine provided by the embodiments of the present application, the de-icing efficiency of the ice-making box 102 can be improved by arranging the ice-making device mentioned above in the cabinet body, and it is convenient for the user to assemble and disassemble the ice-making box 102 to facilitate the user to clean the ice-making box 102.

The refrigeration machine provided by the present application can be a refrigerator, a freezer and other refrigeration machine involving ice making and ice storage.

Finally, it should be noted that the above embodiments are only used to illustrate the solutions of the present application, rather than limiting the solutions. Although the present application is described in detail with reference to the above embodiments, those of ordinary skill in the art should understand that: they can still modify the solutions recorded in the above embodiments, or make equivalent replacements to some of the features; these modifications or replacements do not make the essence of the corresponding solutions depart from the scope of the solutions of various embodiments of the present application.

The above embodiments are only used to illustrate the solutions of the present application, rather than limiting the solutions. Although the present application is described in detail with reference to the above embodiments, those of ordinary skill in the art should understand that the various combinations, modifications or equivalent replacements of the solutions of the present application are not divorced from the scope of the solutions of the present application, and should be covered in the scope of the claims of the present application.

What is claimed is:

1. An ice-making device, comprising:

a bracket, provided with a plurality of ice-making boxes;

a handle, mounted on the bracket; and a connector, connected between the handle and the plurality of ice-making boxes to facilitate the handle to drive the plurality of ice-making boxes to act, wherein the connector is provided with a plurality of releasing holes and a plurality of limiting holes being in one-to-one correspondence with the handle and the plurality of ice-making boxes and communicating with each other;

the connector is configured to switch between a releasing position and a limiting position, at the releasing position the handle and the plurality of ice-making boxes respectively are configured to disassemble from the releasing holes, and at the limiting position the handle and the plurality of ice-making boxes respectively are configured to connect to the limiting holes.

2. The ice-making device of claim 1, wherein the bracket comprises a panel and a frame connected to the panel, the handle is rotatably connected to the panel, and the plurality of ice-making boxes are rotatably connected to the frame.

3. The ice-making device of claim 2, wherein an aperture of each of the releasing holes is larger than an aperture of each of the limiting holes and a transition section is provided between each of the releasing holes and each of the limiting holes, and an aperture at the transition section is smaller than an aperture of the limiting hole.

4. The ice-making device of claim 3, wherein the operating member is provided with a first connecting column comprising a first connecting section and a first limiting section, wherein a diameter of the first connecting section is matched with an aperture of each of the plurality of releasing holes, and a diameter of the first limiting section is matched with an aperture of each of the plurality of limiting holes.

5. The ice-making device of claim 4, wherein the first limiting section is provided with a first transition surface for passing the first limiting section through the transition section.

6. The ice-making device of claim 4, wherein the panel is provided with a through hole and a guide groove, wherein the handle is provided with a connecting head in rotation-match with the through hole, and the first connecting column is adapted to pass through the guide groove to connect to the connector.

7. The ice-making device of claim 4, wherein each ice-making box is provided with a second connecting column which comprises a second connecting section and a second limiting section, wherein a diameter of the second connecting section is matched with an aperture of each of the plurality of releasing holes, and a diameter of the second limiting section is matched with an aperture of each of the plurality of limiting holes.

8. The ice-making device of claim 7, wherein the second limiting section is provided with a second transition surface for passing the second limiting section through the transition section.

9. The ice-making device of claim 7, wherein two opposite ends of the frame are provided with a plurality of assembly holes configured to mount the plurality of ice-making boxes, and the plurality of ice-making boxes are provided with installation columns configured to install in the plurality of assembly holes.

10. The ice-making device of claim 9, wherein the frame is provided with a stopper bar, and the stopper bar abuts against ice trays of the plurality of ice-making boxes to limit a swivel angle of the plurality of ice-making boxes relative to the frame.

11. The ice-making device of claim 9, wherein each installation column is sleeved with a resetter configured to switch the plurality of ice-making boxes from a de-icing state to an ice-making state, and two ends of the resetter abut against the plurality of ice-making boxes and the frame, respectively.

12. The ice-making device of claim 11, wherein the resetter is a torsion spring.

13. The ice-making device of claim 1, further comprising an ice storage box arranged below the bracket and corresponding to the plurality of ice-making boxes.

14. The ice-making device of claim 13, further comprising a housing, wherein the bracket and the ice storage box are movably mounted on the housing.

15. A refrigeration machine, comprising a cabinet body and the ice-making device of claim 1, wherein the ice-making device is arranged in the cabinet.

* * * * *